United States Patent [19]

Vargo, Jr. et al.

[11] 4,101,064

[45] Jul. 18, 1978

[54] SLUG RIVETING APPARATUS

[75] Inventors: Joseph Vargo, Jr., West Seneca; John W. Davern, North Tonawanda, both of N.Y.

[73] Assignee: General-Electro Mechanical Corp., Buffalo, N.Y.

[21] Appl. No.: 797,682

[22] Filed: May 17, 1977

Related U.S. Application Data

[62] Division of Ser. No. 735,388, Oct. 26, 1976, Pat. No. 4,060,189.

[51] Int. Cl.[2] ..... B21J 15/36

[52] U.S. Cl. ..... 227/53

[58] Field of Search ..... 227/51, 52, 53, 61, 227/62; 29/243.53, 243.54, 526

[56] References Cited

U.S. PATENT DOCUMENTS

| | | | |
|---|---|---|---|
| 1,340,361 | 5/1920 | Badenhausen | 29/243.54 |
| 2,458,152 | 1/1949 | Eakins | 227/51 |
| 3,557,442 | 1/1971 | Speller | 227/53 |
| 3,600,928 | 8/1971 | Retherford | 29/243.54 |

*Primary Examiner*—Granville Y. Custer, Jr.

*Attorney, Agent, or Firm*—Christel & Bean

[57] ABSTRACT

The invention relates to slug riveting apparatus wherein a pair of opposed rivet head forming anvils move relatively toward each other to form heads at the opposite ends of a cylindrical rivet blank, more or less simultaneously, after the blank has been inserted in the workpieces. An annular elastomeric polyurethane member is associated coaxially with one of the rivet head forming anvils and has a bore for receiving and resiliently gripping a cylindrical rivet blank. The elastomeric annular member holds the blank during insertion of the blank in the workpieces as the anvils move relatively toward each other, and the rivet blank is moved out of engagement with the elastomeric annular member by the associated head forming anvil during the head forming operation by resilient radial expansion of the elastomeric annular member. The rivet forming anvils have flat bottomed head forming recesses with sloping side walls. The flat bottoms of the recesses are of substantially the same diameter as the ends of the rivet blanks or slugs to retain the latter in an accurately centered coaxial position with respect to the head forming anvils throughout the slug insertion and the head forming operations.

4 Claims, 5 Drawing Figures

SLUG RIVETING APPARATUS

This is a division of application Ser. No. 735,388 filed Oct. 26, 1976, now U.S. Pat. No. 4,060,189.

BACKGROUND OF THE INVENTION

This invention relates to riveting devices and more particularly to devices for effecting what is known in the art as slug riveting.

In slug riveting the blank rivets are plain cylindrical members which are inserted in workpieces and both ends of the slug are upset after such insertion to form rivet heads at opposite sides of the workpieces. In prior art apparatus of this general class a substantial problem has existed in effectively feeding rivet blanks or slugs to the riveting mechanism and in inserting the blanks in the rivet holes of the workpieces.

The achievement of these objects in prior art slug riveting apparatus is further complicated by the necessity for accurately controlling the axial position of the rivet blank or slug so that the slug projects the proper distance from the work at opposite sides thereof at all stages of the inserting and head forming operations. This latter necessity must be met so that the proper amount of blank material is present at opposite sides of the work to properly form heads at the opposite sides of the work.

A further problem in prior art slug riveting has been the difficulty of maintaining the rivet slug in an accurately aligned position coaxial with the rivet head forming anvils.

In prior art slug riveting it has been necessary to rely upon the holes in the work pieces for locating the rivet slugs in a radial direction but the necessary clearance or tolerance between the slug diameter and the hole diameter is such that accurate axial alignment of the rivet slug cannot be achieved. In fact, the problem of rivet slug alignment is of such an aggravated nature that with relatively thin work pieces reliance on the holes in the work pieces for locating the rivet slugs is ineffectual and it is accepted in the present state of the art that whenever the thickness of the work pieces is less than about 60 percent of the rivet diameter slug riveting cannot be employed.

This problem is even greater in the case of riveting work wherein steel rivets are to be applied to punched holes in work pieces since in this case even greater tolerances are required as between the rivet slug diameter and the diameter of the punched holes in the work pieces.

SUMMARY OF THE INVENTION

The present invention provides an annular elastomeric member in combination with the riveting means at one side of the workpieces for receiving a rivet blank or slug and for releasably holding the same during insertion into the workpieces and until head formation has begun. The slug is initially resiliently held in an opening in the elastomeric member which is concentric with the rivet forming anvils and is adjacent to one of them and the member is so formed that the rivet-holding opening therein is expanded by the associated rivet head forming anvil as the latter moves toward the work in a head-forming operation.

In the apparatus of the present invention the opposed rivet head forming anvils have head forming recesses therein which have flat bottoms of the same diameter as the ends of the slug or blank and have sloping side walls so that the ends of the slug are guided to seat against the flat bottoms of the recesses and are thus retained in an accurately aligned coaxial position with respect to the rivet head forming anvils.

Thus the rivet slugs are accurately located coaxially with respect to the rivet head forming anvils entirely independently of the walls of the rivet holes in the work pieces. This not only produces superior rivet joints from the standpoint of accuracy, but entirely eliminates any limitations previously regarded as absolutely unavoidable namely, the relationship between the thickness of the work pieces and the diameter of the rivet blank. This greatly increases the range of effective usefulness of slug riveting since the work pieces can be as thin as desired due to the fact that the function of the rivet holes in locating the rivet slug is entirely eliminated.

DESCRIPTION OF THE ILLUSTRATED EMBODIMENT

Figure 1:
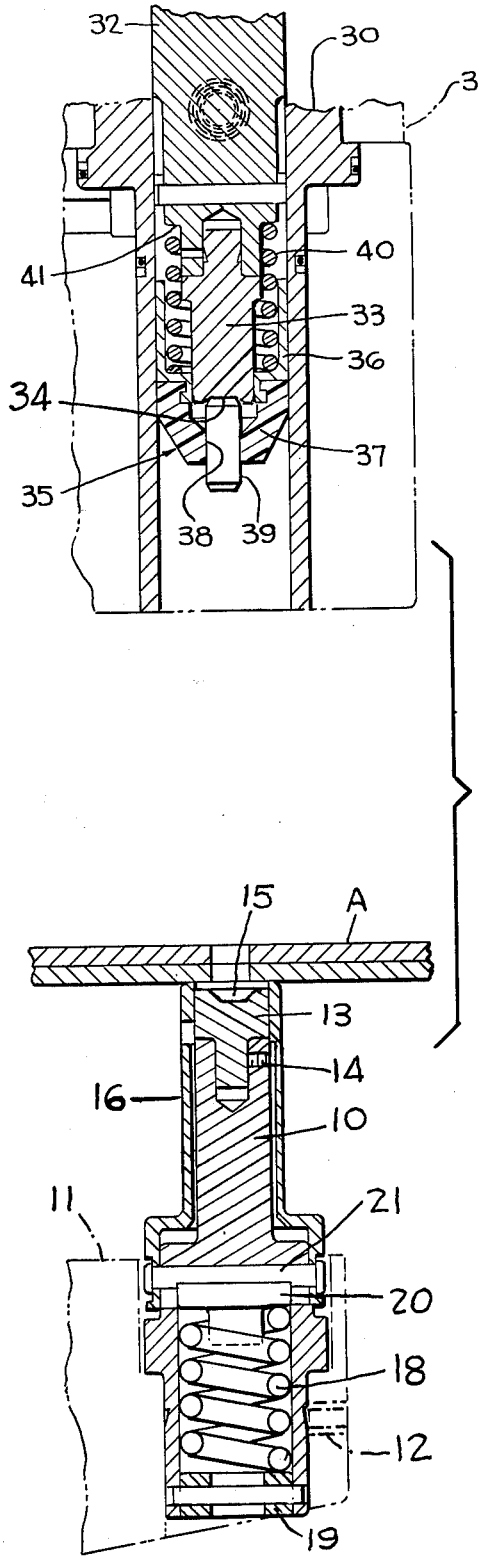
FIGS. 1 through 4 are similar views taken on a plane extending along the axis of the riveting apparatus and showing successive positions of the parts as the rivet blank insertion and head forming operation proceeds.

In the drawings the numeral 10 designates a lower anvil support which is removably fixed to the lower leg 11 of a C-frame member of the riveting apparatus by a setscrew 12 or the like and has a rivet head forming anvil 13 at its upper end which is removably retained by a setscrew 14. This much of the anvil support structure is fixed and immovable during riveting operations. A rivet head forming recess at the upper end of lower anvil 13 is designated 15 and has a flat circular bottom wall and a sloping frusto-conical side wall.

A workpiece clamping sleeve 16 telescopes over the upper end of lower anvil support 10 and is vertically slidable thereon. The lower end of anvil support 10 is hollow and receives a compression coil spring 18 which seats upon a plug 19. A pressure pad 20 seats upon the upper end of coil spring 18 and a cross pin 21 which bears in the lower end of clamp sleeve 16 rests in a semi-circular groove in the top of pressure pad 20. Thus the coil spring 18 urges the clamp sleeve 16 resiliently upwardly with respect to the anvil support 10. In FIG. 1 the clamp sleeve 16 is in its upper limit position with respect to anvil support 10.

Referring now to the upper riveting mechanism, a bearing 30 is fixed to or forms a part of the upper leg 31 of the C-frame member mentioned above. A C-frame is mentioned here merely by way of example and actually the upper end lower riveting mechanisms may be supported in any desired manner. A ram element 32 is slidable vertically in bearing 30 and connects at its upper end with power means (not shown) which reciprocates ram 32 vertically to effect rivet head forming strokes. A rivet head forming anvil 33 is secured to the lower end of ram 32 as clearly shown in FIG. 1. The lower face of anvil 33 has a head forming recess 34 which duplicates the head forming recess 15 of lower anvil 13, having a flat bottom and a frusto-conical side wall. Thus the chamfered ends of a rivet slug 39 seat in the recess with its reduced diameter and faces seated flat against the bottom walls of the head forming recesses 15 and 34 by which means the slug is accurately centered and is retained in a coaxial position with respect to the upper and lower head forming means. Of course, with rivet slugs which do not have chamfered ends the flat bottom walls of the head forming recesses 15 and 34 will be of the full diameter of the rivet slug.

A combined spring pad and slug receiving and retaining member designated generally by the reference numeral 35 is likewise vertically slidable in bearing 30 and comprises a sleeve 36 and an elastomeric slug retainer 37 of polyurethane or similar material. It will be noted that the lower end of sleeve 36 and the upper end of elastomeric slug retainer 37 are mutually formed so that the latter may be stretched over the bottom flange of the sleeve 36 and thus snapped into secure assembly with the sleeve.

The lower end of slug retainer 37 is frusto-conical and has an opening 38 for receiving and resiliently gripping a rivet blank or slug 39. The mechanism for inserting successive slugs in the retainer 37 is shown and described in a companion patent application of Dario Anselmo being filed contemporaneously herewith.

It will be noted that the interior opening of retainer 37, from the upper end of opening 38, flares outwardly to a diameter which receives the lower end of rivet head forming anvil 33. A compression coil spring 40 seats at its lower end in sleeve 36 and bears at its upper end against an external ledge 41 on rod 32. Spring 40 urges the slug receiving and retaining member 35 resiliently downwardly relative to rod 32 and anvil 33.

Figure 2:
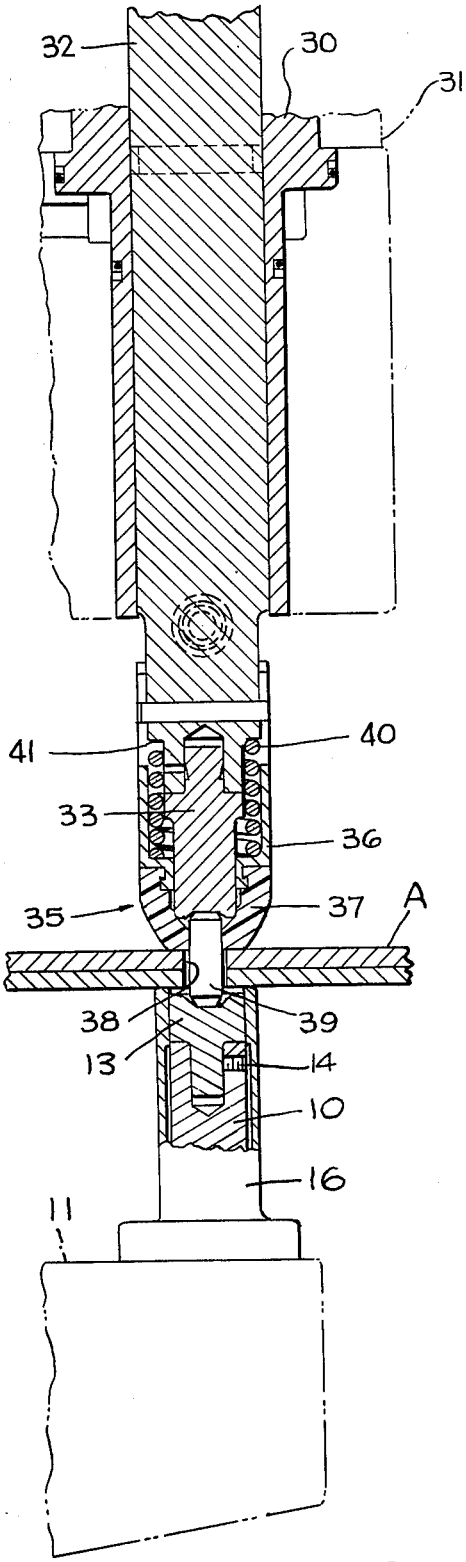

Beginning with the parts in the position shown in FIG. 1 and with a rivet slug 39 inserted in the elastomeric member 37, the ram is forcibly projected downwardly by the aforesaid hydraulic operating means until the slug 39 is inserted in the holes in workpieces A with its lower end seated centrally in the recess 15 of the lower rivet head forming anvil 13 as illustrated in FIG. 2. During the latter part of this downward movement the coil spring 40 is compressed somewhat whereby the elastomeric member 37 is resiliently pressed against the surface of the top workpiece and the workpieces A are, accordingly, gripped between the top end of clamping sleeve 16 and the lower surface of elastomeric member 37.

In the final portion of the slug inserting movement which brings the parts to the position illustrated in FIG. 2, the upper head forming anvil 33 beings to move downwardly into the flared opening portion which extends downwardly to the rivet gripping opening 38 of the elastomeric member 37. Further downward movement of ram 32 and its associated head forming anvil 33 brings the coild of spring 40 to a substantially bottomed condition and, accordingly, movement of the parts from the position of FIG. 2 to that of FIG. 3 results in a spreading of the lower end of elastomeric member 37 radially outwardly by reason of the movement of the lower end of anvil 33 downwardly along the frusto-conical flaring internal portion of the latter.

Figure 3:
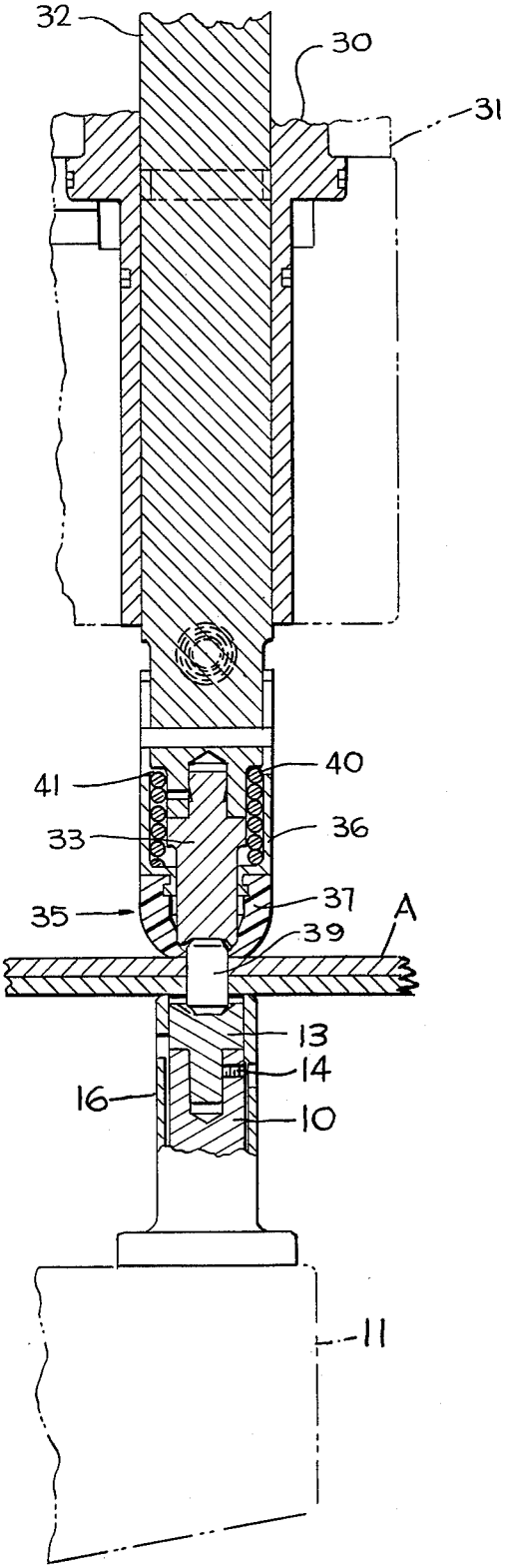
Figure 4:
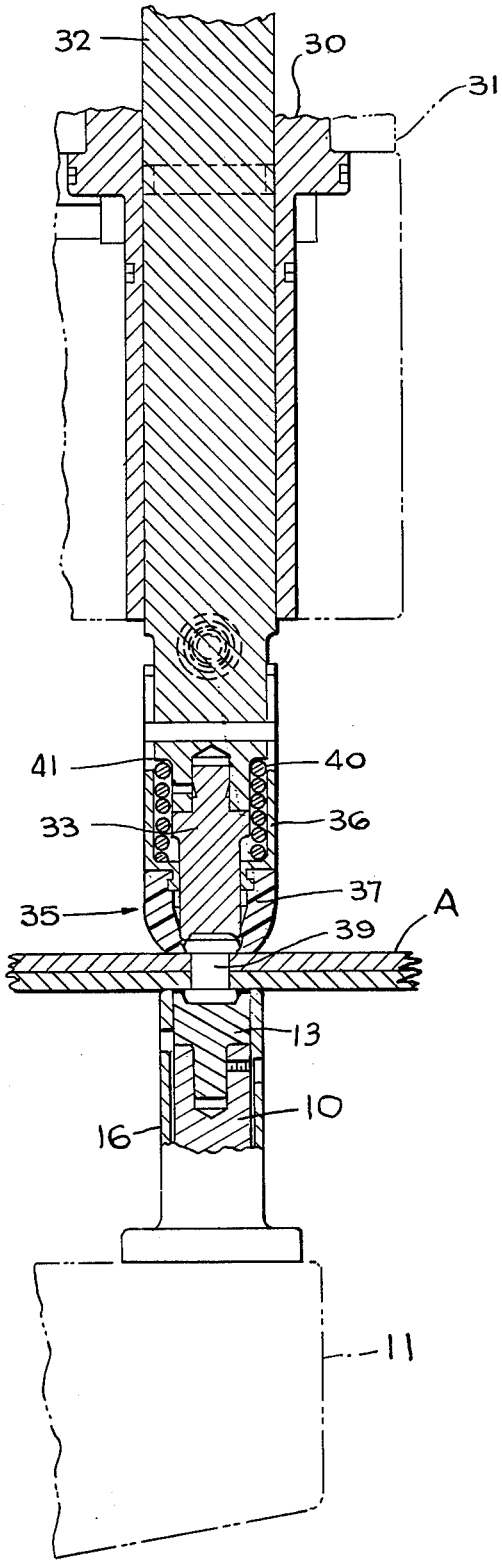

During this movement the rivet blank 39 bulges radially outwardly as will be seen from a comparison of FIGS. 2 and 3. Further downward movement of ram 32 and anvil 33 from the position of FIG. 3 to the position illustrated in FIG. 4 forms the heads at the opposite ends of rivet blank 39 and this continued downward movement of upper anvil 33 further distends elastomeric member 37 radially outwardly to the condition illustrated in FIG. 4. In movement of the parts from the position of FIG. 3 to the position of FIG. 4 the lower end of elastomeric member 37 is distended during formation of the upper rivet head but remains in closely embracing contact with such head. As this movement proceeds, the downward force of the parts due to the head formation which occurs at both ends of rivet blank 39 causes the clamp sleeve 16 of the lower pressure foot to move downwardly to a point where it is just slightly above the upper end of lower head forming anvil 13.

From the foregoing, it will be seen that the elastomeric member 37 securely grips the rivet blank 39 until the latter is fully inserted in the work, whereupon the operation of upper anvil 33 distends the elastomeric member 37, particularly the lower portion thereof, but this distension leaves the lower end of member 37 in closely embracing relation with the forming rivet head, as described above. The elastomeric retainer 37 is far simpler in construction and operation than prior art rivet blank positioning devices and is highly reliable in operation permits the rivet blank to be accurately positioned coaxially with respect to the head forming anvils.

The elastomeric member 37 serves the further useful purpose of supporting the rivet blank resiliently so that the blank may adjust its position in radial directions to correct for slight misalignments so that the opposite ends of the blank seat securely and accurately in the head forming recesses of the anvils 13 and 33 as previously described.

A preferred material for the annular elastomeric rivet blank holder 35 is polyurethane having a hardness of approximately 90 on the Shore A durometer scale. This hardness measurement may range between about 85 to 95 with generally satisfactory results. Other natural or synthetic materials having equivalent physical properties may, of course, be employed.

Figure 5:
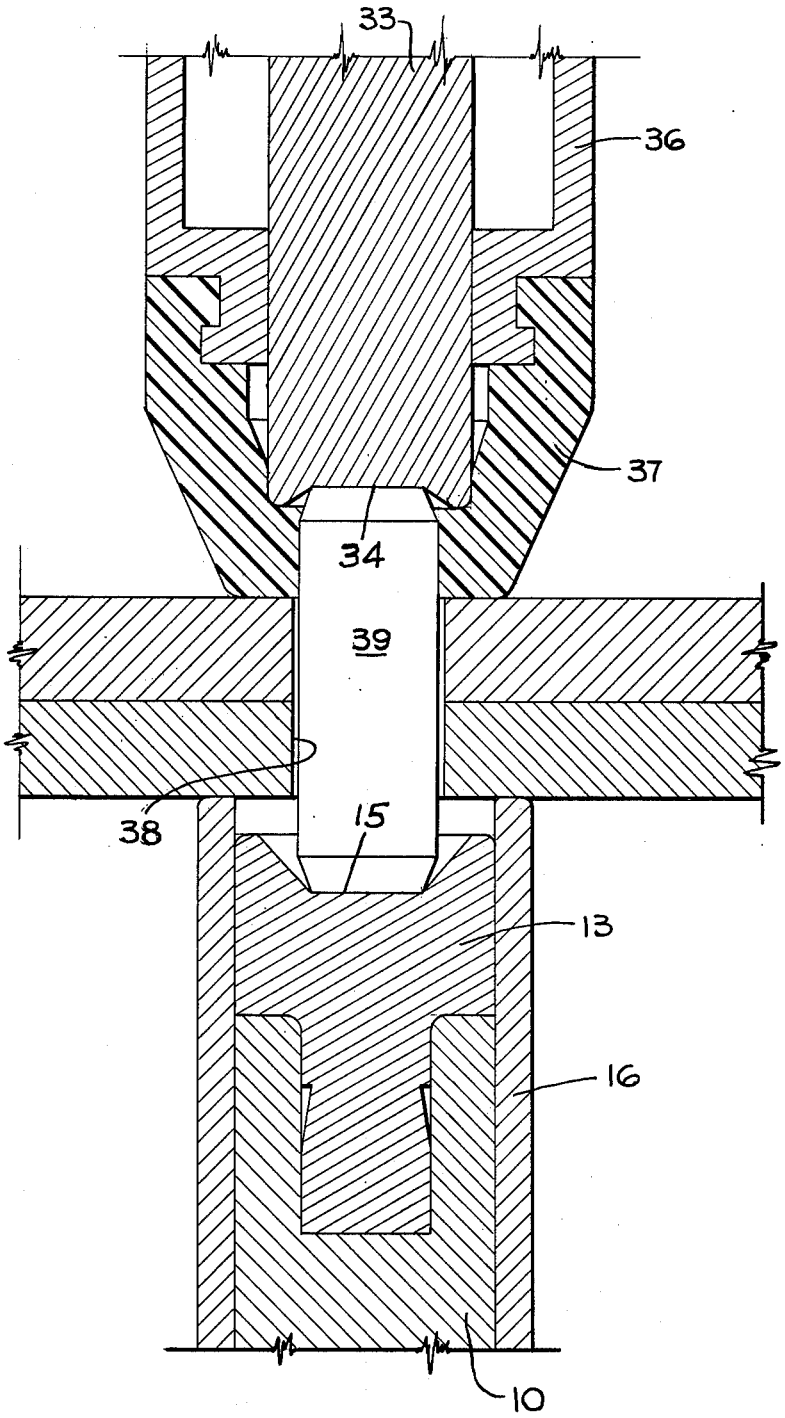
FIG. 5 is a view similar to FIG. 2 but on an enlarged scale and showing only the rivet head forming anvil portions of the mechanism.

FIG. 5 is an enlarged view of the central portion of FIG. 2 to more clearly illustrate the relationship between the rivet slug 39 and the head forming recesses of the upper and lower head forming anvils 13 and 33, such recesses being designated 15 and 34, respectively.

It will be understood that the elastomeric member 37 is resilient and therefore will not maintain the rivet slug rigidly in axial alignment. Furthermore, the rivet slug aligning means of the present invention may be employed with other rivet feeding and inserting means wherein the elastomeric member 37 is not present.

A preferred embodiment of this invention having been hereinabove described and illustrated in the drawings, it is to be understood that numerous modifications thereof can be made without departing from the broad spirit and scope of this invention as defined in the appended claims.

We claim:

1. Apparatus for inserting a generally cylindrical rivet blank in workpieces and for forming heads at opposite ends thereof comprising a pair of coaxial head forming anvils at opposite sides of the workpieces and means for moving said anvils relatively toward each other to form said rivet heads, each of said anvils having a rivet head forming recess therein comprising a flat circular bottom wall of substantially the same diameter as the end of a rivet blank and a flaring side wall for guiding the associated end of said rivet blank into abutment with said bottom wall whereby the rivet blank is accurately positioned and held in coaxial alignment with said head forming anvils.

2. Apparatus according to claim 1 wherein said rivet blanks have chamfered ends and wherein the bottom walls of said anvil recesses are of substantially the same diameter as the chamfered end faces of said rivet blanks.

3. Apparatus according to claim 2 wherein said flaring side walls of said head forming recesses of said anvils are frusto-conical.

4. Apparatus according to claim 1 wherein said flaring side walls of said head forming recesses of said anvils are frusto-conical.

* * * * *